US006810890B2

(12) United States Patent
Lin et al.

(10) Patent No.: US 6,810,890 B2
(45) Date of Patent: Nov. 2, 2004

(54) OBSTRUCTION-FREE GOLF BAG UMBRELLA

(75) Inventors: Chung-Kuang Lin, Taipei Hsien (TW); Jung-Jen Chang, Taipei Hsien (JP)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 41 days.

(21) Appl. No.: 10/245,322

(22) Filed: Sep. 18, 2002

(65) Prior Publication Data

US 2004/0050409 A1 Mar. 18, 2004

(51) Int. Cl.[7] ..... A45B 3/00; A63B 55/00

(52) U.S. Cl. ..... 135/16; 135/20.1; 135/25.4; 135/31; 248/514; 248/160; 403/229; 206/315.4

(58) Field of Search ..... 135/16, 20.1, 25.4, 135/31, 34.2, 18, 25.1; 248/514, 160, 534; 403/220, 229, 291; 206/315.4

(56) References Cited

U.S. PATENT DOCUMENTS

| | | | | | |
|---|---|---|---|---|---|
| 588,958 | A | * | 8/1897 | Crandall | 135/20.1 |
| 3,267,905 | A | * | 8/1966 | Fleming | 119/795 |
| 3,999,730 | A | * | 12/1976 | Gonsalves et al. | 246/434 |
| 4,332,399 | A | * | 6/1982 | Kepple | 280/819 |
| 4,603,904 | A | * | 8/1986 | Tolleson et al. | 297/298 |
| 5,050,627 | A | * | 9/1991 | Hengtzu | 135/23 |
| 5,297,570 | A | * | 3/1994 | Conner | 135/16 |
| 5,986,880 | A | * | 11/1999 | Santeler et al. | 361/684 |
| 6,216,712 | B1 | * | 4/2001 | Lin et al. | 135/31 |
| 6,328,047 | B1 | * | 12/2001 | Lee | 135/20.1 |
| 6,471,289 | B2 | * | 10/2002 | Aguilar | 297/184.16 |

FOREIGN PATENT DOCUMENTS

| | | | |
|---|---|---|---|
| DE | 3721552 | * | 2/1988 |
| JP | 2002-125731 | * | 5/2002 |

* cited by examiner

*Primary Examiner*—Winnie Yip
(74) *Attorney, Agent, or Firm*—Troxell Law Office PLLC

(57) ABSTRACT

A golf bag umbrella includes a central shaft having a bending portion formed on the shaft, a rib assembly pivotally secured to the central shaft having an umbrella cloth secured on the rib assembly, with the rib assembly including at least a top rib pivotally secured to an upper notch formed on a top of the shaft and a stretcher rib pivotally secured between the top rib and a runner sliding on the shaft having the runner approximating the upper notch to form a crescent configuration between the top rib and the stretcher rib for forming a big dome space beneath the umbrella cloth without tangling the movement of the golf clubs when pulled outwardly from the golf bag, whereby upon bending of the central shaft at the bending portion, the umbrella cloth and the rib assembly may be temporarily tilted to allow an easy withdrawal of the golf club from the golf bag without any obstruction.

2 Claims, 4 Drawing Sheets

OBSTRUCTION-FREE GOLF BAG UMBRELLA

BACKGROUND OF THE INVENTION

U.S. Pat. No. 6,263,891 to Hartwell et al. disclosed a golf bag umbrella having a protective cover (20) provided beneath the canopy to prevent entanglement between the golf clubs and the support structure (ribs) of the canopy. However, when pulling the golf club outwardly from the golf bag, the canopy may still obstruct the pulling of the club unless the shaft (16) is extended upwardly to render an enough space for the withdrawal of the club from the golf bag, causing inconvenience for the golf player.

The present inventor has found the drawbacks of the conventional golf bag umbrella and invented the present obstruction-free golf bag umbrella.

SUMMARY OF THE INVENTION

The object of the present invention is to provide a golf bag umbrella including a central shaft having a bending portion formed on an upper portion of the shaft, a rib assembly pivotally secured to the central shaft having an umbrella cloth secured on the rib assembly, with the rib assembly including at least a top rib pivotally secured to an upper notch formed on a top of the shaft and a stretcher rib pivotally secured between the top rib and a runner sliding on the shaft having the runner approximating the upper notch to form a crescent configuration between the top rib and the stretcher rib for forming a big dome space beneath the umbrella cloth without tangling the movement of the golf clubs when pulled outwardly from the golf bag or inserted inwardly into the golf bag, whereby upon bending of the central shaft at the bending portion, the umbrella cloth and the rib assembly may be temporarily tilted to allow an easy withdrawal of the golf club from the golf bag or an easy insertion of the golf club into the bag without any obstruction.

DETAILED DESCRIPTION

Figure 1:
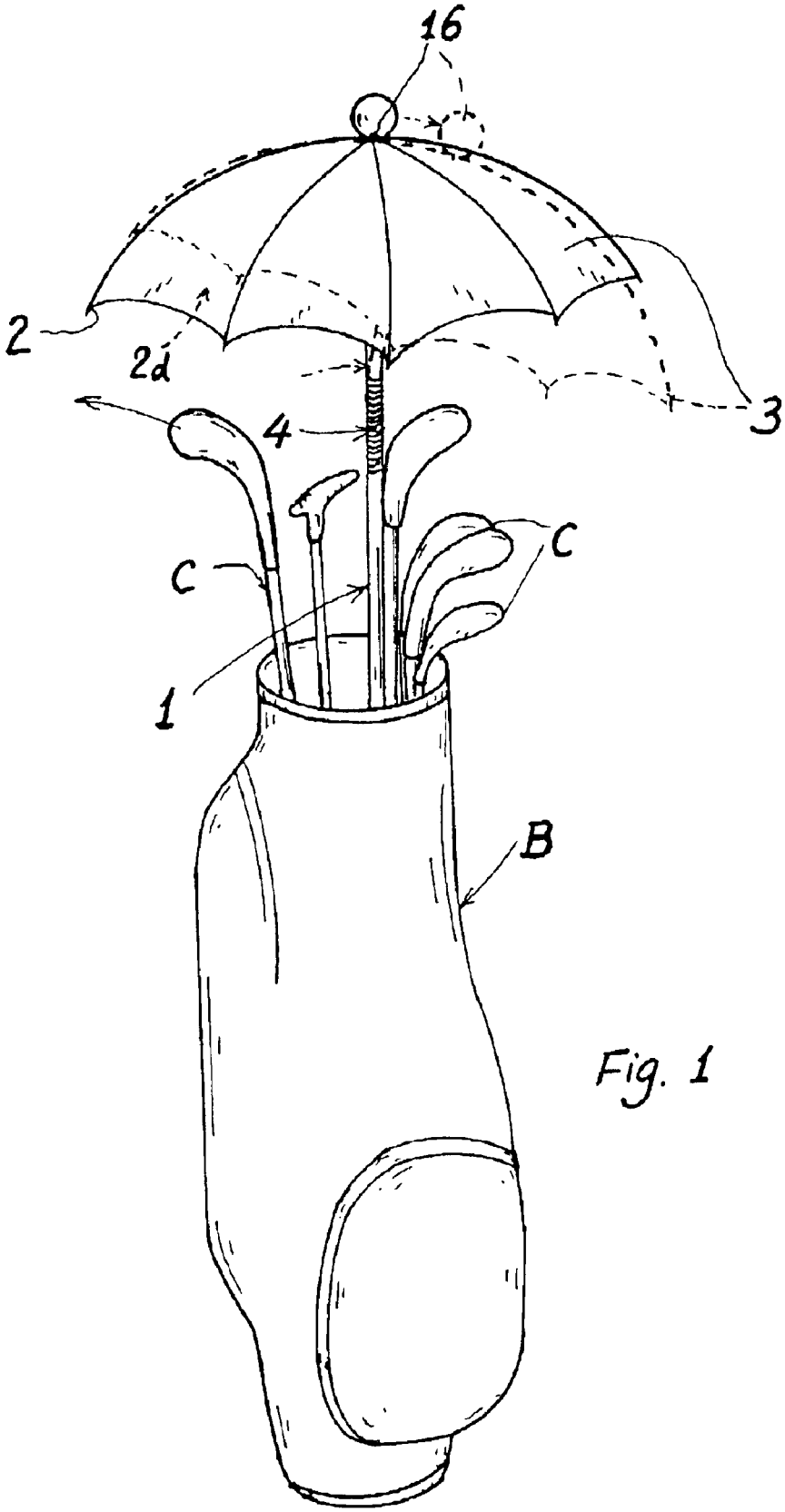
FIG. 1 is a perspective view of the present invention when used in a golf bag.

As shown in the drawing figures, the present invention comprises: a central shaft 1 adapted to be inserted in a golf bag, a rib assembly 2 pivotally secured to the central shaft 1, an umbrella cloth 3 secured on the rib assembly 2, and a bending portion 4 formed on the shaft 1 especially on the upper portion of the shaft 1. Upon opening of the umbrella cloth 3 when opening the umbrella, the golf clubs C in the bag B will be covered and protected.

Figure 4:
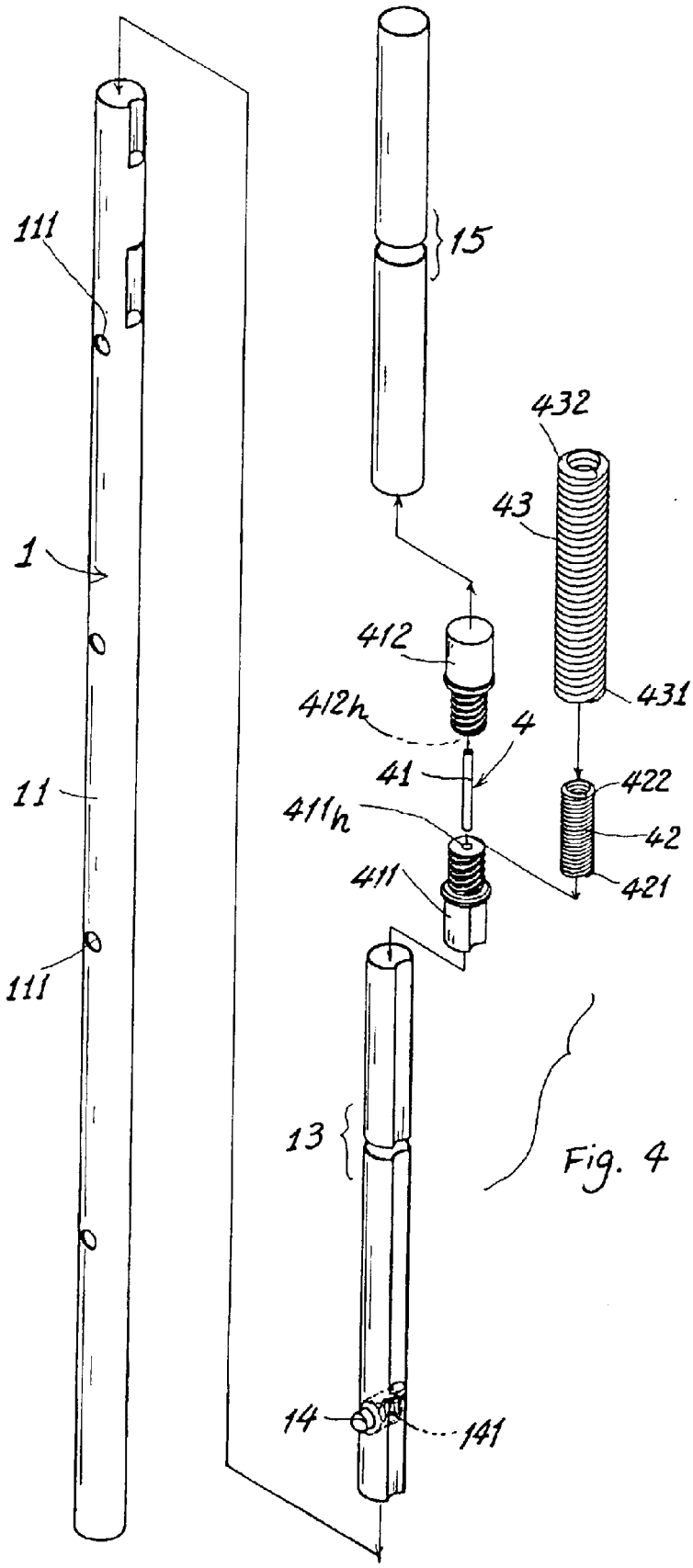
FIG. 4 is an exploded view of the bending portion and the central shaft of the present invention.

The central shaft 1 includes: a lower tube 11 having a grip 12 secured to a bottom portion of the lower tube 11 and having a plurality of adjusting holes 111 equally spaced and formed lengthwise in the lower tube 11; an upper tube 13 telescopically engageable with the lower tube 11 having a push button 14 resiliently secured in a lower portion of the upper tube 13 by a tension spring 141 transversely retained in the upper tube 13 (FIG. 4) and selectively engageable with any one said adjusting hole 111 formed in the lower tube 11; a top tube 15 secured to the upper tube 13 through the bending portion 4; an upper notch 10 formed on a top of the top tube 15; and a top ball 16 formed on a top end of the top tube 15 and the upper notch 10.

The top ball 16 may be shaped as a golf ball or the like. It may also be modified as a "top knob" (16) secured on a top of the shaft 1. The ball 16 may be held by a user's hand for tilting the shaft 1.

The central shaft 1 may be comprised of a plurality of tubes, not limited to that as shown in the drawings as accompanied herewith, telescopically engageable with one another.

The rib assembly 2 includes at least a plurality of top ribs 21 and stretcher ribs 22 pivotally secured to the central shaft 1.

The rib assembly 2 may be formed as single fold (FIG. 1) or multiple folds, not limited in the present invention.

The top rib 21 has its inner end portion 211 pivotally secured to the upper notch 10 on the central shaft 1, an outer end portion 212 secured with an outer periphery of the umbrella cloth 3 having the central portion of the cloth 3 secured to the upper notch 10, and an intermediate connecting portion 213 formed on a middle portion of the top rib 21 to be pivotally secured with the stretcher rib 22.

The stretcher rib 22 has its inner end portion 221 pivotally secured to a runner or lower runner 23 slidably moving on the shaft 1 and an outer end portion 222 of the stretcher rib 22 pivotally secured to the intermediate connecting portion 213 of the top rib 21.

Figure 2:
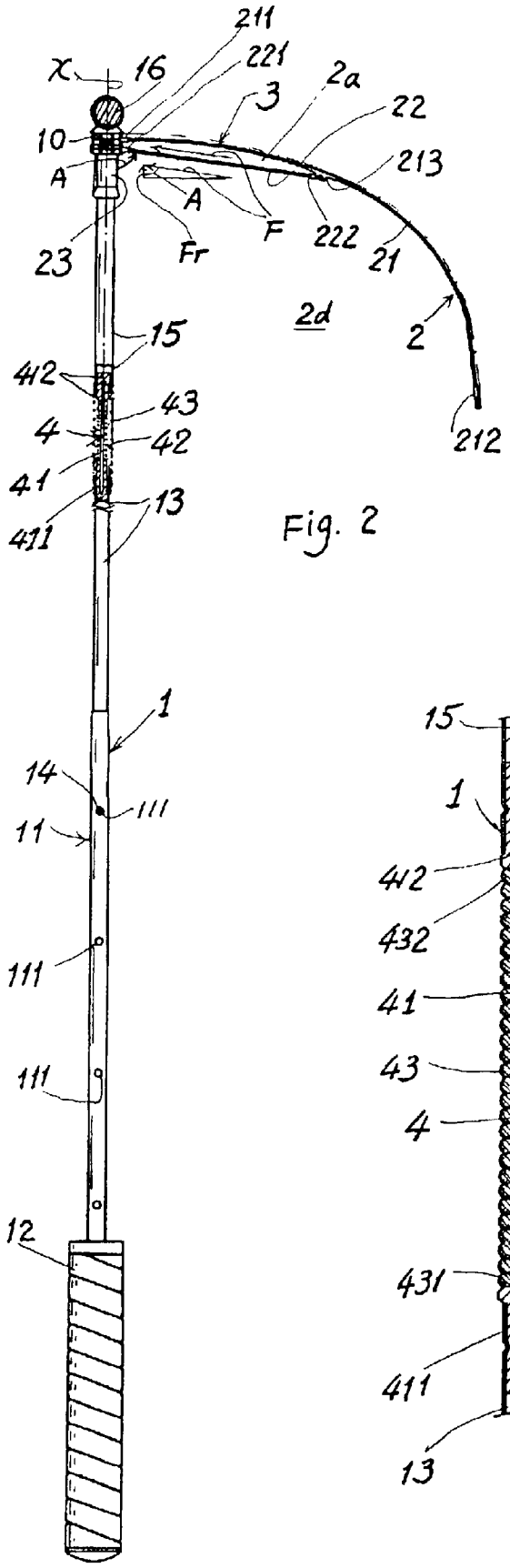
FIG. 2 is an illustration of the present invention when opened.

The runner 23 is contiguous to the upper notch 10 when opening the umbrella (FIG. 2) and the intermediate connecting portion 213 of the top rib 21 is preferably separated from the upper notch 10 with a distance of (or less than) one half length ½ L of the total length (L) of the top rib 21 (FIG. 6); with the stretcher rib 22 approximating (or juxtapositioned to) the top rib 21 to form a crescent configuration 2*a* among the top rib 21, the stretcher rib 22, the upper notch 10 and the runner (or lower runner) 23 contiguous to the upper notch 10 when opening the umbrella as shown in FIG. 2, thereby obtaining a big dome space 2*d* beneath the umbrella cloth 3 and the rib assembly 2 to render an enough space for the easy movement (withdrawal or insertion) of golf club C through the golf bag B (FIG. 1) without obstructing the club C.

The stretcher rib 22 defines an acute angle A (FIG. 2) between the stretcher rib 22 and a longitudinal axis X of the central shaft 1 from the runner 23 towards the grip 12 of the shaft 1, whereby upon acting of a tension force F upon the stretcher rib 22 as urged by the umbrella cloth 3 when opening the umbrella, it will produce a force fraction Fr ($Fr=F\cdot\cos A$) lifting the runner 23 upwardly without descending the runner 23 and the rib assembly 2 pivotally secured with the runner 23. Therefore, a spring catch (not shown) as resiliently provided in a shaft of a conventional umbrella to lock the runner at its opening state can then be eliminated in this invention. So, this invention also provides a catch-free umbrella for simpler and costly production.

The bending portion 4 includes: a flexible core rod 41 connecting the upper tube 13 and the top rib 15, a restoring spring 42 disposed around the flexible core rod 41 and retained between the upper tube 13 and the top tube 15, and a reinforced restoring spring 43 further disposed around the restoring spring 42 and also retained between the upper tube 13 and the top rib 15.

The flexible cord rod 41 may be made of resilient materials including metal and plastic materials.

Other bending mechanisms may be modified and used in the present invention.

The flexible core rod 41 may be retained between a lower plug 411 secured to the upper tube 13 and an upper plug 412 secured to the top tube 15.

The restoring spring 42 or 43 has its lower spring end 421 or 431 retained on the lower plug 411; and has an upper spring end 422 or 432 retained on the upper plug 412.

Figure 3:
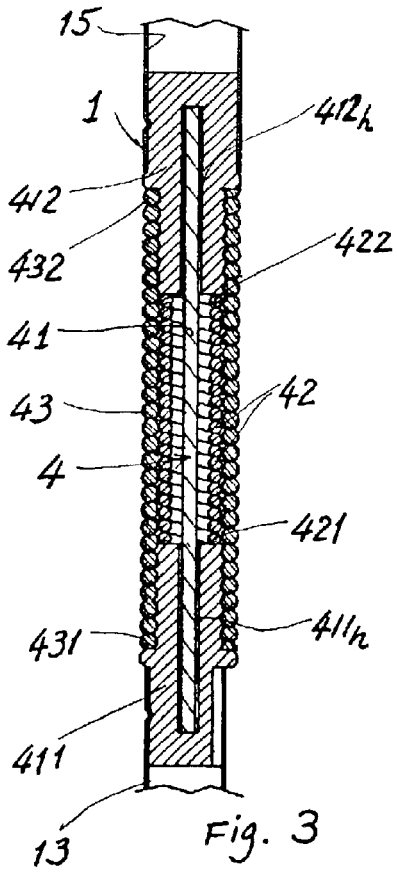
FIG. 3 is a sectional drawing showing the bending portion of the present invention.

The lower plug 411 and the upper plug 412 are respectively formed with rod holes 411*h*, 412*h* to be engaged with the bottom and top ends of the core rod 41 (FIG. 3).

For a single-fold shaft 1, the bending portion 4 may then be connected between an upper shaft portion and a lower shaft portion (not shown). The restoring spring 42 or 43 may be a single spring. The core rod 41 may also be eliminated for simplifying the production and lowering the lowering the cost.

Figure 5:
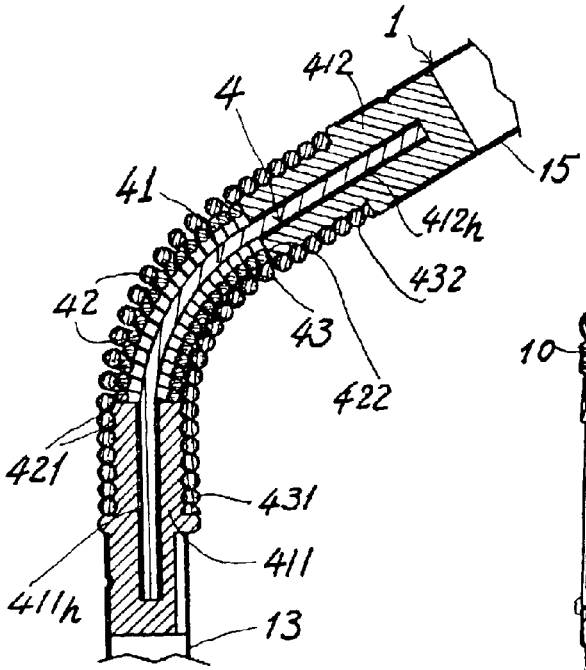
FIG. 5 is a sectional drawing of the bending portion when bent.

When withdrawing a golf club C from the gold bag B (FIG. 1), the shaft 1 may be slightly bent at the bending portion 4 (as shown in FIG. 5 and in dotted line of FIG. 1) to tilt the umbrella cloth 3 for a convenient movement of the golf club C without any obstruction by the umbrella.

For taking a shorter golf club such as a short iron (rather than a longer wood), the club C may be directly taken out from the bag B without tilting the shaft since each stretcher rib 22 is quite approximating each top rib 21 (forming a crescent configuration 2*a* and big dome space 2*d* as shown in FIG. 2) to form a big dome space 2*d*, allowing a convenient movement of the golf club C beneath the stretcher and top ribs 22, 21 without tangling or obstructing the club C.

Figure 6:
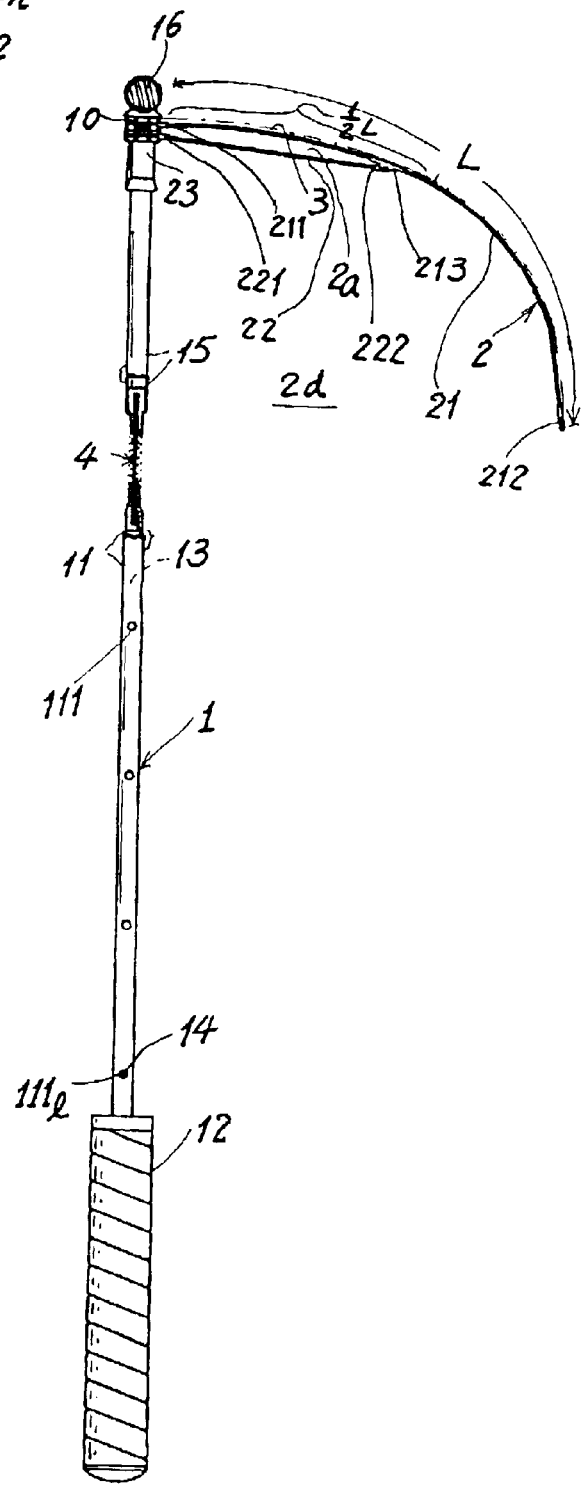
FIG. 6 shows the present invention when partially retracting the tubes of the central shaft.

For retracting or lowering the tubes of the shaft 1 as shown in FIG. 6 (from FIG. 2), the push button 14 may then be engaged with a lowest hole 111*l* to shorten the length (or height) of the shaft 1. The upper tube 13 may be adjustably engaged with the lower tube 11 by selectively engaging the push button 14 with any hole 111 formed in the tube 11.

The present invention is superior to the conventional golf bag umbrella with the following advantages:

1. A bending portion 4 is provided on the shaft 1 for easily tilting the shaft for allowing a convenient withdrawal of club C from the bag B or insertion into the bag.
2. The stretcher rib 22 is approximating the top rib 21 to form a crescent configuration 2*a*, thereby remaining a bigger dome space 2*d* beneath the cloth 3 and the rib assembly 2. Since the stretcher rib 22 is "positioned" as high as possible, the golf club will not be tangled or obstructed by the ribs 22 and the "protective cover" for covering the ribs as provided by the U.S. Pat. No. 6,263,891 is no longer required.

The present invention may be modified without departing from the spirit and scope of the present invention.

We claim:

1. A golf bag umbrella comprising:

a central shaft adapted to be inserted in a golf bag;

a rib assembly pivotally secured to the central shaft and having an umbrella cloth secured thereon, said rib assembly including at least a top rib pivotally secure to an upper notch formed on a top of said central shaft, and a stretcher rib having an inner end portion pivotally secured to a runner sliding on said central shaft, and an outer end portion secured to an intermediate connecting portion of said top rib, said intermediate connecting portion of said top rib defining a half-length (½L) between said intermediate connecting portion and said upper notch based on a total length (L) of the top rib; said stretcher rib juxtapositioned to said top rib and having a crescent configuration among said top rib, said stretcher rib, said upper notch and said runner as being contiguous to said upper notch when opening the umbrella, and forming a dome space beneath said stretcher rib and said top rib to prevent obstruction to movement of a golf club when withdrawn from the golf bag;

an acute angle being formed between the stretcher rib and a longitudinal axis of the central shaft from the runner towards a grip of said shaft when opening the umbrella; and a bending portion formed on said central shaft, said bending portion including a flexible core rod retained between a lower shaft tube and an upper shaft tube of said central shaft, and a restoring spring disposed around said flexible core rod and retained between said lower shaft tube and said upper shaft tube; whereby upon opening of the umbrella, the umbrella cloth will cover and protect a plurality of golf clubs as stored in the golf bag; and whereby upon bending of the central shaft at the bending potion, the umbrella will be slightly bent to allow a convenient withdrawal of a golf club from the golf bag without being obstructed.

2. A golf bag umbrella according to claim 1, wherein said bending portion further includes a reinforced restoring spring disposed around said restoring spring, and retained between said lower and upper shaft tubes.

* * * * *